US007458873B2

(12) United States Patent
Gilbert

(10) Patent No.: US 7,458,873 B2
(45) Date of Patent: Dec. 2, 2008

(54) FLYING MERCHANDISE

(75) Inventor: Neil Young Gilbert, Falmouth, ME (US)

(73) Assignee: Rokbird International, LLC, Falmouth, ME (US)

( * ) Notice: Subject to any disclaimer, the term of this patent is extended or adjusted under 35 U.S.C. 154(b) by 205 days.

(21) Appl. No.: 11/229,824

(22) Filed: Sep. 19, 2005

(65) Prior Publication Data

US 2007/0077851 A1 Apr. 5, 2007

(51) Int. Cl.
*A63H 27/127* (2006.01)

(52) U.S. Cl. ..... 446/46; 720/118

(58) Field of Classification Search ..... 446/46–48; 720/718, 720; 119/707–709
See application file for complete search history.

(56) References Cited

U.S. PATENT DOCUMENTS 4,262,911 A * 4/1981 Opresik et al. ..... 473/613
4,351,129 A 9/1982 Kerkenbush et al.
5,195,916 A * 3/1993 Her ..... 446/46
5,277,641 A * 1/1994 Gable et al. ..... 446/46
5,423,705 A 6/1995 Solomon, II
5,799,616 A * 9/1998 McClung, III ..... 119/709
5,934,966 A * 8/1999 Ward ..... 446/46
6,092,489 A 7/2000 Huettner et al.
6,672,253 B1 1/2004 Viola
2004/0107431 A1 * 6/2004 Wilcoxson et al. ..... 720/718
2004/0205807 A1 * 10/2004 Wilcoxson et al. ..... 720/720

* cited by examiner

*Primary Examiner*—Kien Nguyen
(74) *Attorney, Agent, or Firm*—Neil Y. Gilbert

(57) ABSTRACT

The present invention relates to a flying object having a recess or orifice for removably securing an article of merchandise and to the combination of a flying object and an article of merchandise removably secured to the flying object.

9 Claims, 5 Drawing Sheets

FLYING MERCHANDISE

BACKGROUND

Flying objects, such as discs, are well known. The Frisbee® brand flying disc from Wham-O, for example, has been commercially available for decades. Flying discs are typically manufactured using plastic, foam or other rigid or semi-rigid materials and can be cylindrical in form or have curved surfaces to enhance flight. Flying discs have been disclosed that have various structures associated with the discs, such as permanent inserts (U.S. Pat. No. 4,351,129 (Kerenbush et al.); Wham-O), laminate surfacing (U.S. Pat. No. 5,423,705 (Morrow); Kransco), rope material (U.S. Pat. No. 6,672,253 (Viola)); and balls bonded to the disc (Happy Dog Toys, LLC; product packaging citing U.S. Pat. No. 6,092,489 (Heuttner et al.)).

Various industries choose to promote their products by supplying free samples of the product or by providing merchandise that has an association with the particular product or industry. The recording industry, for example, may give away compact discs, electronically stored music (i.e. MP3 media), concert tickets or clothing to promote a band, concert or new release. Sports teams, for example, give away collectible cards, key chains, clothing or game tickets. The beverage industry is also well known for advertising; free or discounted product is typically offered to start the launch of a new brand or to increase interest in an existing brand. These and other industries have also recently moved towards providing consumers with gift cards that contain electronic information relating to monetary credit or other units of value. Examples include phone cards, restaurant cards, cards bearing credits for coffee (such as for Starbucks or Dunkin' Donuts), and cards for credit at particular retail stores or groupings of stores (i.e. malls). Persons interested in these and other products and services are typically the focus of marketing efforts of retailers, manufacturers and service providers.

There exists a continuous need for new and innovative methods and devices for marketing and promoting products and services.

SUMMARY

The present invention relates to the combination of a flying object and an article of merchandise removably secured to the flying object. The article of merchandise is preferably associated with the flying object such that it does not significantly interfere with the throwing, flying or catching of the object. The article is also preferably removably secured such that it does not become detached during normal throwing, flying or catching of the object yet is removable without excessive force from the object when the user desires to separate the two items. In a particular embodiment, the flying object is a disc. However, other objects, for example, balls, footballs and boomerangs can be used. The present invention also relates to a flying object that has a recess or orifice configured and dimensioned to removably secure an article of merchandise.

DETAILED DESCRIPTION

Figure 1:
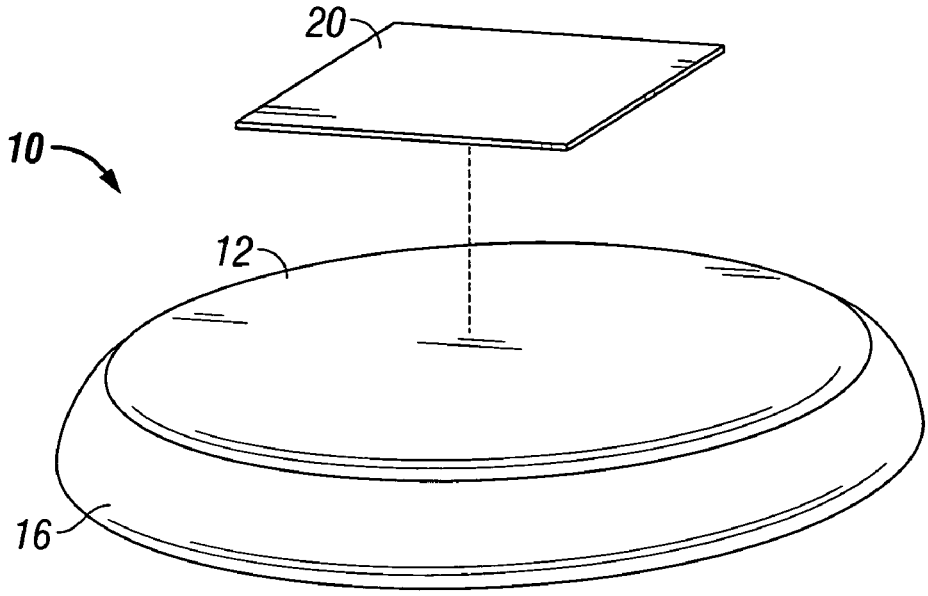
FIG. 1 is an exploded, perspective view of an information card associated with a flying disc.

With reference to FIG. 1, flying object 10 is a disc that has a convex upper surface 12, a concave lower surface 14 (not shown) and a generally circular rim 16 around the circumference. The flying disc can also be a cylinder (i.e., no curved surfaces) or other shape wherein the center of gravity is preferably located in the center of the object. Typical flying discs range from about three inches in diameter to about 20 inches in diameter. Disc 10 can be manufactured from solid plastic or of foamed synthetic materials, such as foamed polyurethane. Flying discs can be made by known techniques, such as, for example, by blow molding, injection molding, vacuum molding or stamping.

Also shown in FIG. 1 is article of merchandise 20 which is exemplified as a gift card. The term "article of merchandise" means anything of value that can be removably secured to a flying object (with or without packaging, i.e. a protective case or wrapper), so long as the article does not significantly disturb the ability of the object to be thrown and caught. An article of merchandise can include, for example: a compact disc bearing electronic media (e.g. music and/or video media); electronically stored music (i.e. MP3 media); event tickets; coupons; key chains; novelty items; collectible cards; or cards having information (e.g. magnetic or bar-code) that relates to value, i.e. a quantity of money or other units that the card is good for. Information cards can include, for example: phone cards; restaurant cards; cards bearing credits for beverages such as coffee (such as from Starbucks or Dunkin' Donuts), soda (such as from Coke or Pepsi) or beer (such as from Budweiser, Miller or Coors); and cards for credit at particular retail stores (such as from The Gap; Foot locker; The Discovery Store; Macy's) or groupings of stores (e.g. malls).

If the flying object is to be used to transport an article of merchandise to a random user in a crowd of people (such as a band throwing a CD (or other article containing musical information) or other article of merchandise item to a listening audience), the object, such as a flying disc, is preferably made of a relatively soft material to reduce the likelihood of injury to an unaware fan.

The manner or means for removably securing the article of merchandise to the flying object can take many forms such as, for example: single or double sided tape; Velcro® fastener material; rigid or semi-rigid plastic that releasably engages the article of merchandise (e.g. flexible fingers that engage the center opening of a compact disc or rigid anchors attached to the object that releasably receive at least a portion of the article of merchandise); glue; and sticky gum-like material (such as a viscoelastic polymer). Alternately, or in addition to the aforementioned materials, the object can have one or more recesses or orifices strategically placed to at least partially receive at least a portion of the article of merchandise or packaging containing the article of merchandise. Such pre-formed recesses or orifices can optionally be dimensioned slightly smaller than the article so as to frictionally hold the article in place. Perimeter portions of the recess or orifice can further include a continuous or intermittent lip of material that covers a portion of the article of merchandise to further aid in holding the merchandise in place until the user desires to separate the two items. One or more articles of merchandise can be associated with a single flying object as can one or more recesses or orifices be disposed in a single flying object. Preferably, the article is removable secured to the flying object so as not to significantly disturb the object's center of gravity.

The term "removably secured" means that the article of merchandise generally does not become detached during-normal throwing, flying or catching of the object yet is removable without excessive force from the object when the user desires to separate the two items. "Excessive force" is an amount of force that would damage the article of merchandise or an amount of force greater than that which an adult human can apply.

Figure 2:
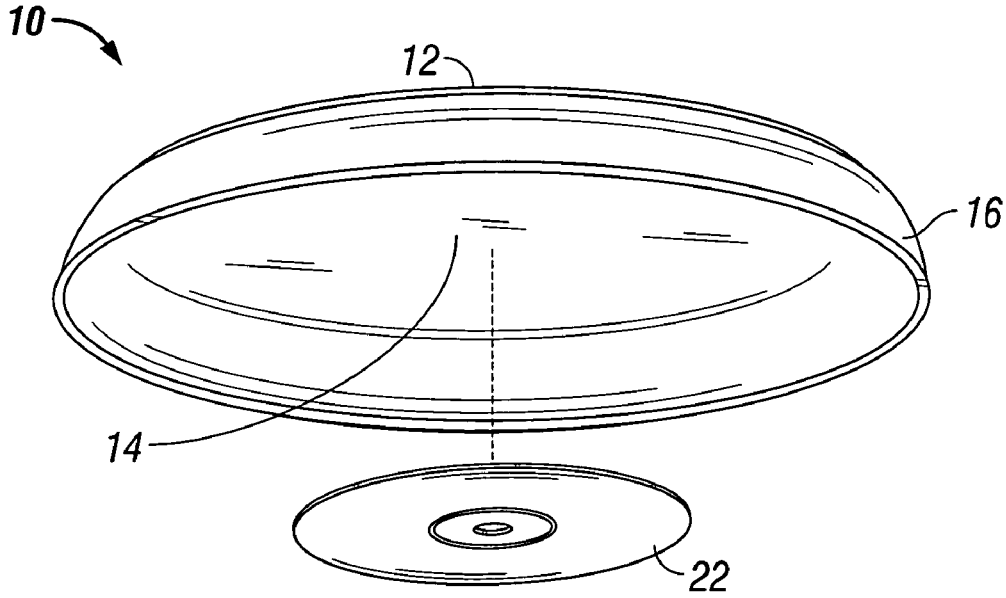
FIG. 2 is an exploded, perspective view of a compact disc associated with a flying disc.

Turning to the remaining Figures, FIG. 2 shows flying disc 10 with compact disc 22 removable secured to lower surface 14. Compact disc 22 can be removably secured as discussed, above. Alternately, compact disc 22 can be disposed within a jewel box (i.e. a rectangular or circular CD container) wherein the container is removably secured to either upper surface 12 or lower surface 14 of flying disc 10.

Figure 3:
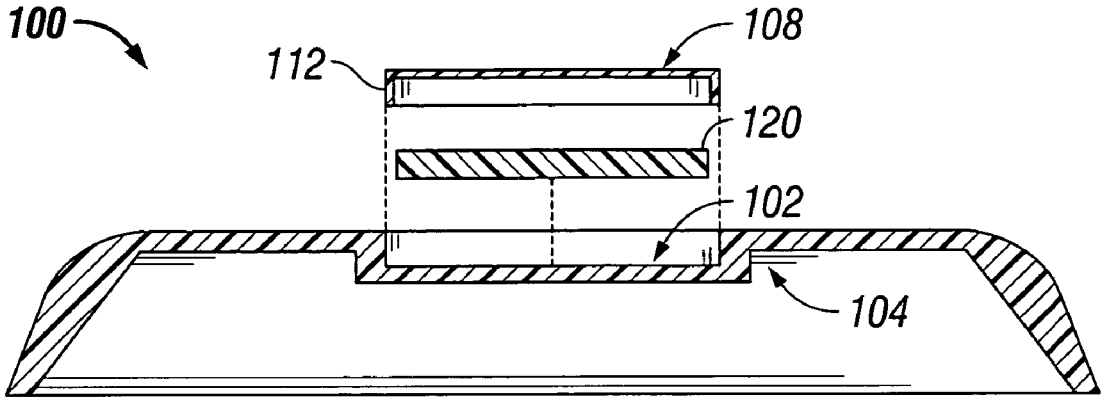
FIG. 3 is an exploded cross-sectional view of a disc having a recess, merchandise and cover member.

FIG. 3 shows flying disc 100 having pre-formed recess 102 configured and dimensioned to receive article of merchandise 120 and optional cover member 108. The lower portion of flying disc 100 has step 104 that generally corresponds to recess 102, thereby providing a continuous web of material across the flying disc. Alternatively, recess 102 can be formed on the lower surface of disc 100 with step 104 being on the upper portion of the disc. Cover member 108 is optional and serves to cover or otherwise protect and/or removably retain article of merchandise 106 on flying disc 100. Cover member 108 is preferably dimensioned to be frictionally associated with recess 102 and has top portion 110 and legs/rim portion 112. Cover member 108 can be fabricated from clear material to allow the user to see article of merchandise 106. Alternatively, cover member 108 can have graphics disposed directly thereon or contain an insert (not shown) with graphics or other indicia. During use, the user can receive the flying disc and remove article of merchandise 120. If cover member 108 is used, the cover member is removed first and optionally replaced after removing the article of merchandise.

Figure 4:
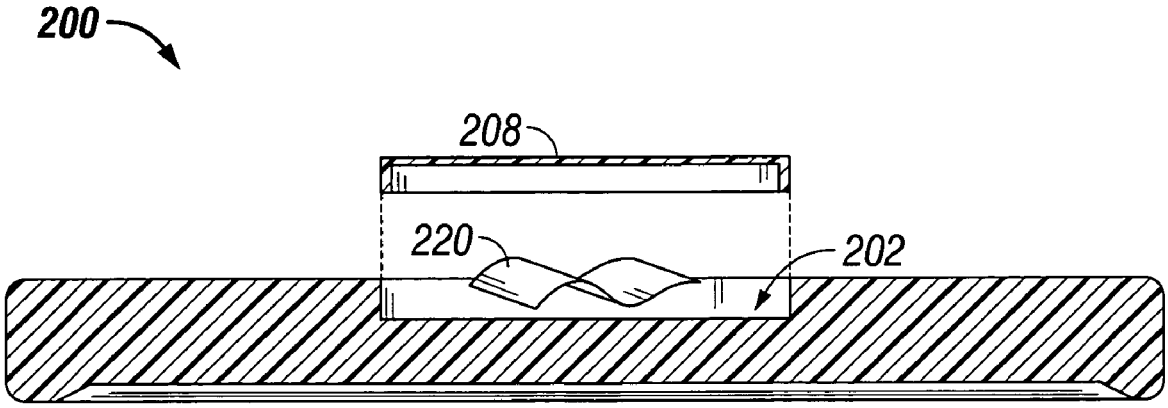
FIG. 4 is an alternate embodiment of a disc with a recess in cross-section and associated merchandise and cover member.

An alternate embodiment of a flying disc is shown in FIG. 4. Flying disc 200 is generally cylindrical and has recess 202 formed therein. Article of merchandise 220 is removably secured to flying disc 200 by means of cover member 208.

Figure 5A:
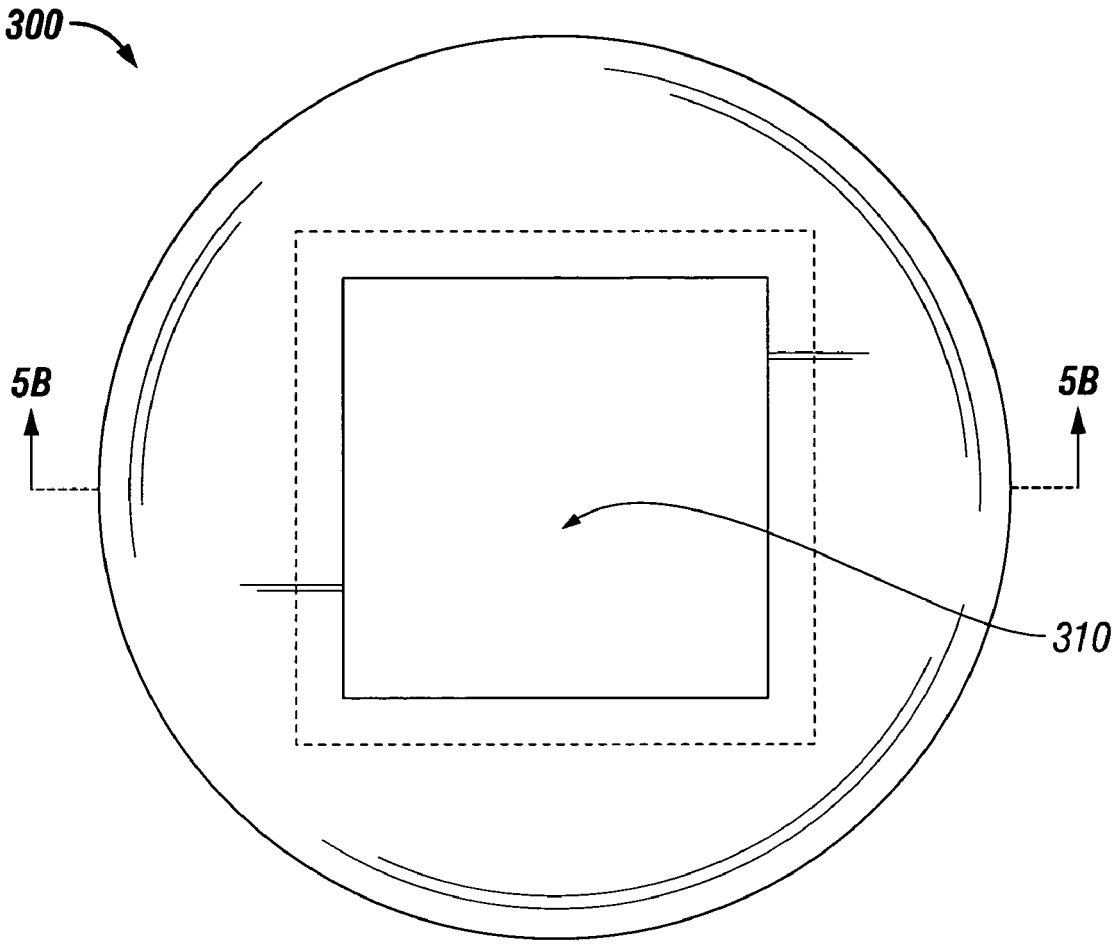
FIG. 5A is a disc having a centrally located orifice and upper and lower lips of material for removably securing an article of merchandise.
Figure 5B:
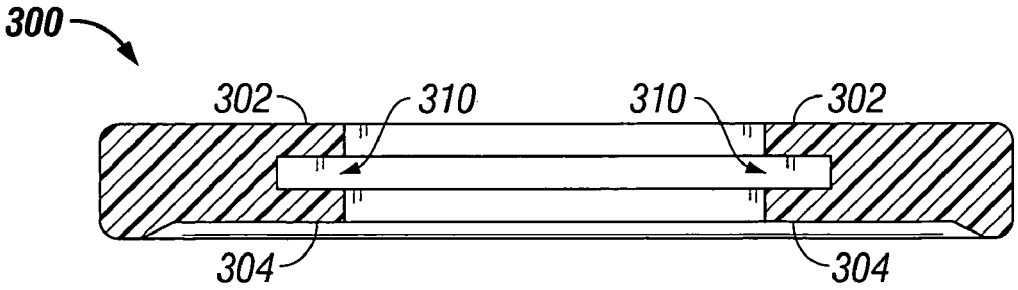
FIG. 5B is a cross-sectional view of FIG. 5A.

FIGS. 5A and 5B show another flying disc embodiment, 300. Flying disc 300 has rectangular orifice 310 and upper and lower lips of material 302 and 304 that are continuous about orifice 310. Orifice 310 can be of any configuration (e.g. rectangular, hexagonal, circular, etc. . . ). Lips 302 and 304 can be intermittent or otherwise discontinuous and are preferably made of the same material as flying disc 300. An article of merchandise (not shown) can be removeably secured within orifice 310 and between lips 302 and 304, wherein the user can see both top and the bottom portions of the article prior to removal. Orifice 310 can vary in thickness (e.g. from about 0.25 inches to about 3 inches), length (e.g. from about 0.25 inches to about 19 inches) and width (e.g. from about 0.25 inches to about 19 inches). By way of example, if the article of merchandise is a compact disc in a rectangular jewel box, the dimensions of orifice 310 would be about 5.6 inches by 4.9 inches by 0.4 inches (the general outer dimensions of a typical jewel box) and the lip portions, where present, would be between about 0.01 inches to about 0.5 inches in thickness and have between about 0.01 inches to about 0.5 inches of overhang. The overhang and thickness of the lip material depends on how tightly the article of merchandise needs to be held and on the type of material used to manufacture the flying disc. Lip portions can also be used in flying object embodiments having a recess, wherein the lip portions serve to removably secure the article of merchandise and/or cover member within the recess.

Figure 6A:
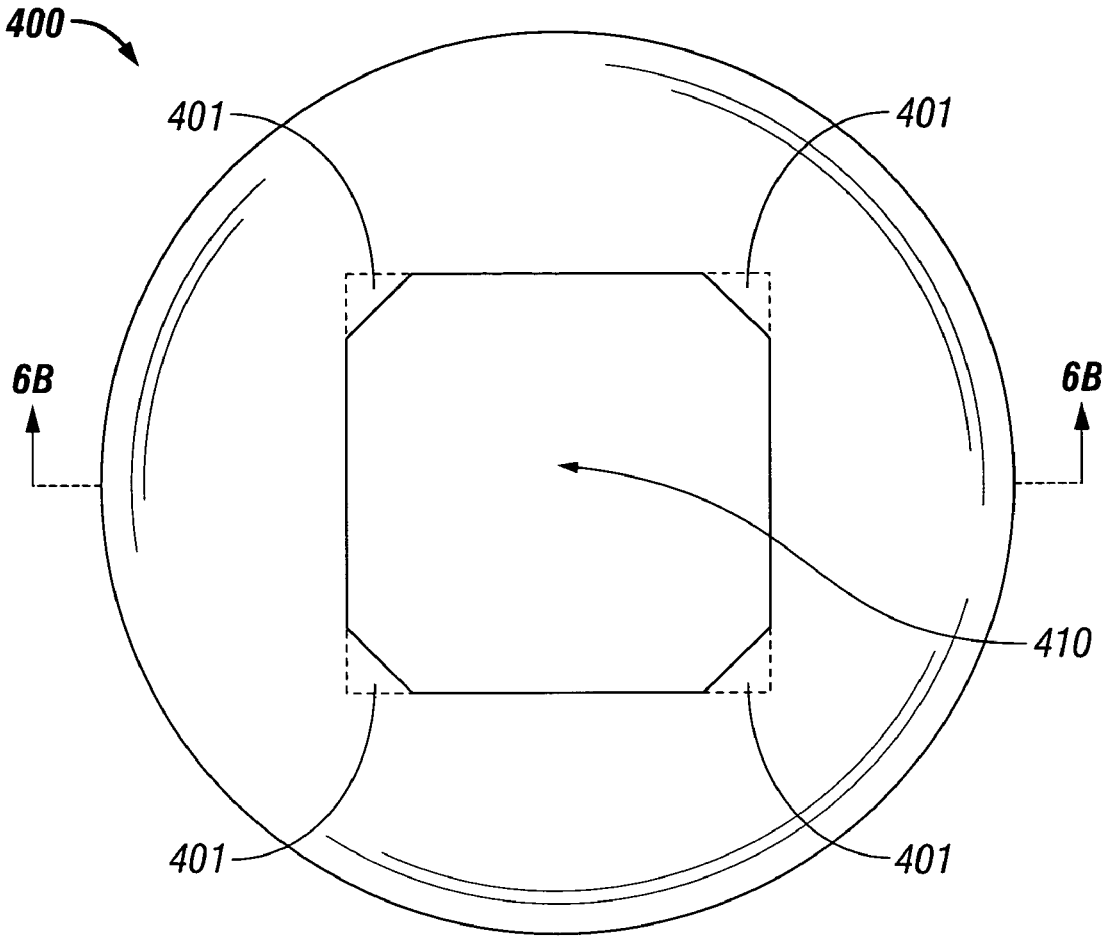
FIG. 6A is a disc having a centrally located orifice and upper and lower corner portions for removably securing an article of merchandise.
Figure 6B:
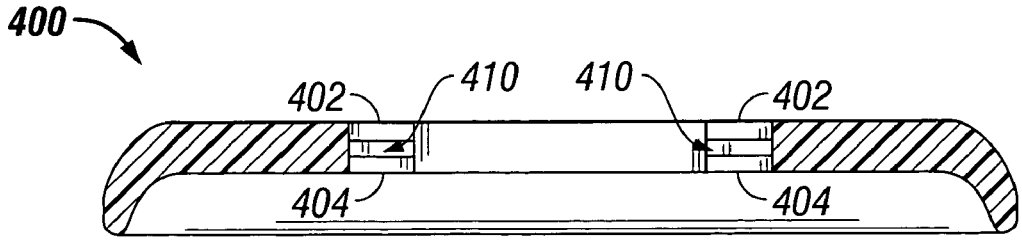
FIG. 6B is a cross-sectional view of FIG. 6A.

FIGS. 6A and 6B show another flying disc embodiment, 400. Flying disc 400 has orifice 410 and four comer portions 401, each having upper and lower lip portions 402 and 404. This particular configuration allows better visualization of an article of merchandise (not shown) as compared to the particular embodiment shown in FIGS. 5A and 5B.

Figure 7:
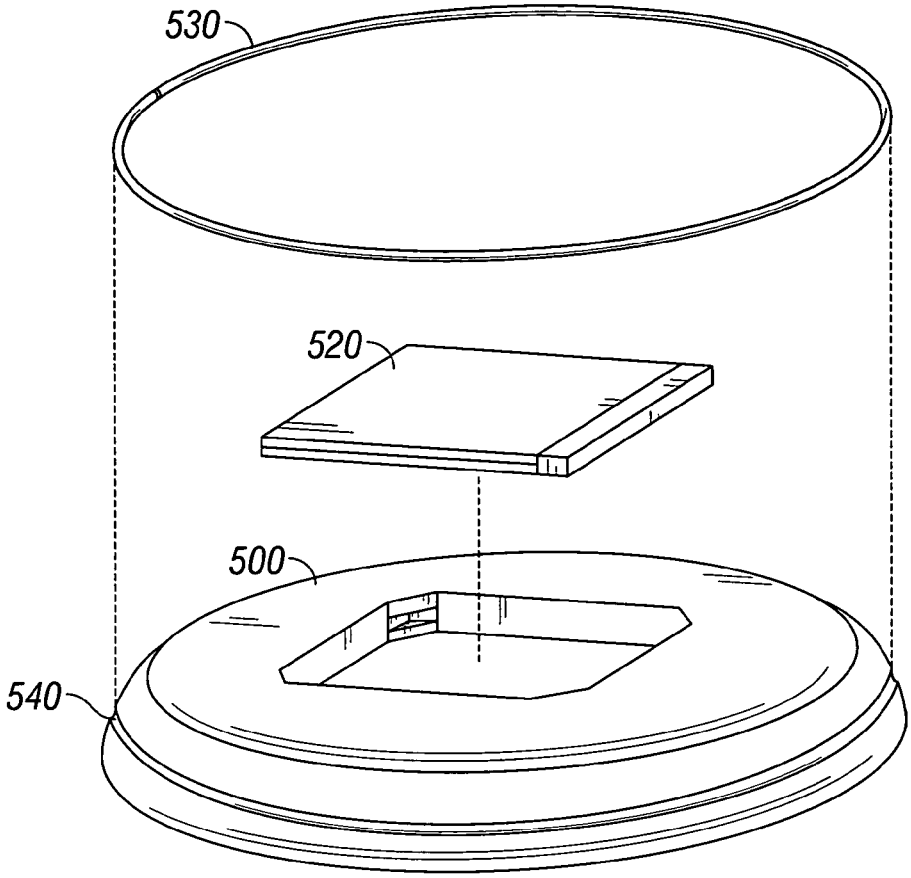
FIG. 7 is and exploded perspective view of a disc having a centrally located orifice with upper and lower comer portions for removably securing a first article of merchandise and a groove portion for removably securing a second article of merchandise.

FIG. 7 shows disc 500 having a central orifice (similar to orifice 410 in FIGS. 6A and 6B) configured and dimension to removably secure article of merchandise 520 (shown as rectangular compact disc jewel box 520) and groove 540 configured and dimensioned to removably secure article of merchandise 530. Article of merchandise 530 can be a novelty item, such as a necklace. In one embodiment, article of merchandise can be a chemiluminescent glow necklace (plastic tubing enclosing two chemicals that emit light when mixed). A typical, commercially available glow necklace is about 22 inches in length and between about 4 to about 6 millimeters in diameter. Groove 540 can be disposed on the rim of disc 500, on the upper surface of disc 500 and/or on the lower surface of disc 500. Multiple grooves and/or orifices can be provided to receive a plurality of novelty items on a single flying object.

Figure 8:
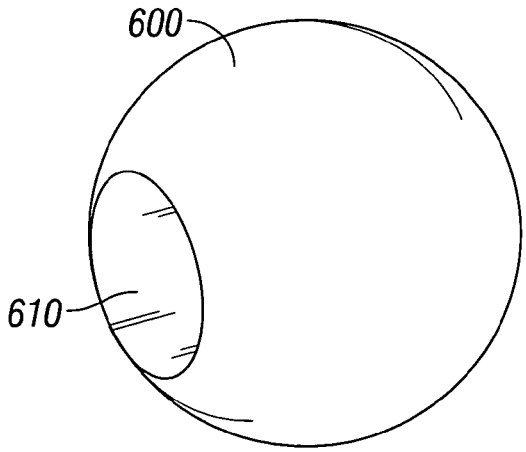
FIG. 8 is a spherical flying object having an orifice for removaby securing an article of merchandise.

FIG. 8 shows spherical ball 600 having recess/orifice 610 disposed therein. Recess 610 can be circular (as shown) or any other configuration to removably secure an article of merchandise.

Optionally, the flying object can have indicia and/or graphics printed or otherwise disposed thereon that correspond to indicia, graphics and/or the nature of the article of merchandise removably secured thereto. For example, a particular band's name, logo or other artwork can be on a flying disc in combination with a sample of the band's music removably secured to the disc. In another example, a trademark, logo or artwork associated with a particular manufacturer or retailer can be disposed on the flying object with a gift card from such manufacturer or retailer removably secured to the object.

While the above illustrative embodiments of the present invention have been described herein with respect to the accompanying drawings, it is to be understood that the invention is not limited to those precise embodiments, and that various other changes and modifications may be affected therein by one skilled in the art without departing from the scope or spirit of the invention. For example, while the majority of the above discussion relates to flying discs, clearly, other objects can be used to deliver articles of merchandise, such as, for example, balls, footballs and boomerangs, wherein the merchandise is removably secured on an outer surface of the object or is disposed within a recess or orifice formed in the object.

What is claimed is:

1. A merchandise delivery system comprising:

a flying disc having an upper surface, a lower surface and a generally rectangular orifice passing through the upper and lower surfaces, the generally rectangular orifice having four corners and being dimensioned to receive a compact disc jewel box;

lip portions disposed in each of the four corners of the generally rectangular orifice, the lip portions being configured and dimensioned to removably secure a compact disc jewel box; and a compact disc jewel box removably secured to the flying disc.

2. The system according to claim 1, wherein the flying disc and compact disc jewel box each have indicia that are related to each other.

3. The system according to claim 1, wherein the compact disc jewel box contains at least one compact disc.

4. A method of delivering music to an audience comprising:

providing a system according to claim 1, wherein the compact disc jewel box contains musical information; and throwing the system to an audience.

5. A merchandise delivery device comprising:

a flying disc having an upper surface, a lower surface and a generally rectangular orifice passing through the upper and lower surfaces, the generally rectangular orifice having four corners and being dimensioned to receive a compact disc jewel box; and lip portions disposed in each of the four corners of the generally rectangular orifice, the lip portions being configured and dimensioned to removably secure a compact disc jewel box.

6. The device according to claim 5, wherein the lip portions disposed in each of the four corners of the generally cylindrical orifice comprise upper and lower portions, each upper and lower portion in each corner being configured and dimensioned to receive a corner of a generally rectangular compact disc jewel box.

7. The device according to claim 6, wherein the generally rectangular orifice has dimensions of about 5.6 inches by about 4.9 inches.

8. The device according to claim 5, further comprising a generally rectangular compact disc jewel box, the jewel box having four corners, each of the jewel box four corners being removably secured to the device.

9. The device according to claim 1, wherein the generally rectangular orifice has dimensions of about 5.6 inches by about 4.9 inches.

* * * * *